United States Patent [19]

Reba et al.

[11] 4,285,452

[45] Aug. 25, 1981

[54] SYSTEM AND METHOD FOR DISPERSING FILAMENTS

[75] Inventors: Imants Reba; Edward C. Wolthausen, both of Vancouver, Wash.

[73] Assignee: Crown Zellerbach Corporation, San Francisco, Calif.

[21] Appl. No.: 68,246

[22] Filed: Aug. 20, 1979

Related U.S. Application Data

[63] Continuation-in-part of Ser. No. 15,272, Feb. 26, 1979, abandoned.

[51] Int. Cl.[3] ..... B65H 51/00; B65H 17/32

[52] U.S. Cl. ..... 226/7; 19/299; 28/289; 226/97

[58] Field of Search ..... 226/7, 97; 19/299, 304; 28/282, 283, 289

[56] References Cited

U.S. PATENT DOCUMENTS

| | | | |
|---|---|---|---|
| 3,325,906 | 6/1967 | Franke | 19/299 |
| 3,460,731 | 8/1969 | Troth, Jr. | 226/97 |
| 3,485,428 | 12/1969 | Jackson | 226/97 |
| 3,601,860 | 8/1971 | Keib | 19/304 |
| 3,738,894 | 6/1973 | Lipscomb et al. | 19/299 X |
| 3,776,796 | 12/1973 | Lipscomb et al. | 19/299 X |
| 4,099,296 | 7/1978 | Gustavsson | 19/304 |

FOREIGN PATENT DOCUMENTS

| | | | |
|---|---|---|---|
| 190555 | 2/1967 | U.S.S.R. | 19/304 |

*Primary Examiner*—Stanley N. Gilreath

*Attorney, Agent, or Firm*—Jerome S. Marger; Corwin R. Horton

[57] ABSTRACT

A system and method are provided for dispersing a plurality of filaments, moving at high velocity, without substantial fiber aggregation, for subsequent uniform deposition on a web-forming surface, by the use of opposed Coanda nozzles. The Coanda nozzles are operated under nonsteady-state conditions whereby a substantially nonsymmetrical filament pattern is created between the opposed Coanda surfaces.

13 Claims, 2 Drawing Figures

SYSTEM AND METHOD FOR DISPERSING FILAMENTS

REFERENCE TO PRIOR APPLICATION

This is a continuation-in-part of application U.S. Ser. No. 15,272, filed Feb. 26, 1979, now abandoned.

BACKGROUND OF THE INVENTION

The present invention relates to a system and method for delivering filaments, preferably heavy denier filaments, in a dispersed state, to the forming surface of a web-forming means.

Filaments for use in the making of nonwovens can be made by various methods. For example, synthetic polymers can be spun into filaments. These spun filaments are typically drawn-off by a high velocity jet system and blown onto a web-forming surface as is the case in U.S. Pat. No. 3,692,618 to Dorschner. The use of these high velocity jets facilitates high draw-off speeds so that large numbers of filaments can be transported through the system on a continuous basis. A compressed fluid, such as air, is typically employed as the transport medium.

A major problem which occurs when a multiplicity of filaments travel through a high velocity jet system is filament aggregation. "Filament aggregation" is defined as the forming of the filaments into bundles which cause significant uniformity and strength problems when a nonwoven web is formed therefrom.

In an attempt to solve this problem, some formation systems employ complex electrostatic charging apparatus to avoid filament aggregation (see U.S. Pat. No. 3,341,394 to Kinney).

Others try to overcome the filament aggregation problem by accelerating and directing the fibers immediately subsequent to their exit from the high velocity jet stream. An example of the above approach utilizes a phenomenon known as the "Coanda effect". The Coanda effect, which has been known for many years, is exemplified by U.S. Pat. No. 2,052,869 issued to Henri Coanda. Briefly, this phenomenon can be described as the tendency of a fluid, which emerges from an opening, such as slit, under pressure, to attach itself or cling to and follow a surface in the form of an extended lip of the slit, which recedes from the flow access of the fluid as it emerges from the slit. This creates a zone of reduced pressure in the area of the slit so than any entrainable material which is in the area would be entrained and flow with the fluid which has attached itself to the extended lip.

Although the use of a means for imparting a reduced Coanda effect to filaments exiting a high velocity jet system may, in some cases, overcome the aggregation problem associated with light denier filaments, heavy denier filaments, i.e., filaments having a denier of at least 4, which are entrained in a transporting fluid, cannot be effectively dispersed by this reduced Coanda effect. More specifically, when a plurality of heavy denier filaments are transported in a fluid medium at high velocity, the filaments exit the jet system through a slit, are discharged to a region formed between a pair of opposed deflector surfaces, and the entrained filaments enter the dispersion region in close proximity to each other. The reduced Coanda effect is not sufficient to overcome the downward inertia of the above heavy denier filaments. Therefore, substantial deflection of the filaments toward the deflection surfaces, at a corresponding substantial dispersion of the filaments, cannot be accomplished. The filaments thus essentially remain in close proximity to each other as they are deposited on the forming wire, which results in the previously described formation problems.

In U.S. Pat. No. 3,485,428 to Jackson, a horizontally disposed, sequentially directed low pressure fluid is intermittently supplied to a diverging chamber through which strands of yarn exit. Thus, the fluid which emanates from the two diametrically opposed jets impinges the high velocity stream of filaments and exerts a "pushing" force or pressure on the filaments in a reciprocating manner. The above approach does not, however, cause the heavy denier fibers previously described to be dispersed in a manner required for effective, nonwoven product formation. Instead, the entire bundle of filaments, which are in close proximity to each other, are moved from side to side as they are impinged by the intermittently directed low pressure air flow without causing effective dispersion of the filaments with respect to each other.

SUMMARY OF THE INVENTION

The subject invention relates to a system and a method for delivering a plurality of dispersed filaments, preferably heavy denier filaments, for deposition on a moving web-forming surface. More specifically, a plurality of filaments are discharged from a jet system in a fluid medium at high velocity and are introduced into a dispersion region formed between respective opposed Coanda nozzles. As described previously, the entrained filaments are in close proximity to each other as they enter the dispersion region. However, in contradistinction to the prior art systems, the filaments passing between the above Coanda nozzles are dispersed so that when they are deposited on a moving web-forming surface, the previously described uniformity and strength problems are substantially eliminated.

The desired filament dispersion is accomplished by providing opposed Coanda nozzles which create a nonsteady-state, nonsymmetrical filament pattern. Preferably, the Coanda nozzles comprise (1) an auxiliary means for supplying a pulsating fluid, which is generally air, preferably at low pressure, and (2) opposed Coanda surfaces. The pulsating fluid attaches to the Coanda surfaces under conditions whereby the fluid flow follows the curved contour of the surfaces to create the requisite Coanda effect. The fluid is supplied in a pulsating manner, creating nonsteady-state conditions with respect to the opposed Coanda surfaces. Preferably, the fluid is sequentially supplied in an alternating mode causing the filaments to oscillate in a plane perpendicular to the Coanda surfaces creating a nonsymmetrical filament pattern within the dispersion region. Thus, as the filaments move in a downward direction past the opposed Coanda nozzles, the filaments are oscillated in a gradually increasing amplitude as they move in a downward direction toward the web-forming surface, the fibers being moved in a plane perpendicular to the Coanda surfaces by the action of the Coanda effect. The oscillation of the filaments causes them to be in a dispersed state when they are deposited on the moving web-forming surface of a web-forming means located below the dispersion region. Accordingly, the nonwoven web produced thereby has excellent uniformity and strength properties.

The auxiliary fluid supply means preferably includes a fluid outlet means which engages, and is preferably attached to, the Coanda surfaces, preferably at the converging portions thereof.

In a preferred embodiment of this invention, the filaments exit the jet system through a discharge means capable of causing dispersion of the filaments in a plane parallel to the Coanda surfaces. This, in conjunction with the above described Coanda nozzles, provides for a two-dimensional dispersion of the filaments at an even higher degree of uniformity and strength in the final nonwoven web.

DETAILED DESCRIPTION OF DRAWINGS

DETAILED DESCRIPTION OF INVENTION

Figures 1, 2:
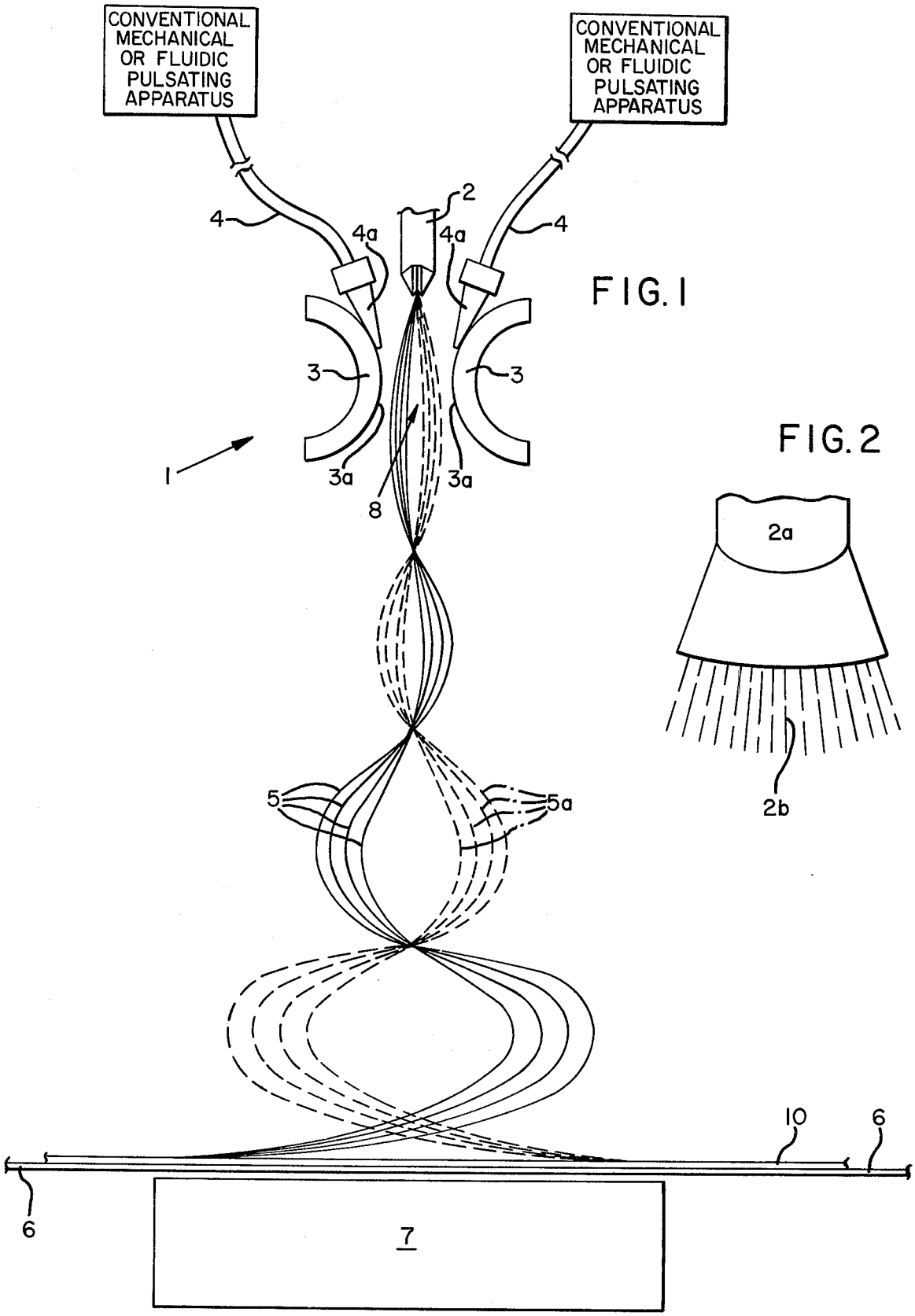
FIG. 1 is a schematic representation of the preferred system of the present invention.
FIG. 2 is an enlarged view of the fan-shaped, diverging nozzle means 2*a*.

Referring now to FIG. 1, a system 1 is provided for delivering a plurality of filaments, peferably heavy denier filaments 5, to a moving web-forming surface 6 of a web-forming means (not shown) in a dispersed condition.

Typically, filaments 5 are produced from polymer materials capable of forming a melt, which can be spun, and which are useful in the production of nonwoven products. These materials are well-known in the prior art.

The filaments 5 are generally formed by conventional melt spinning techniques. A plurality of these spun filaments in the form of bundles are passed, after spinning, to a conventional high velocity jet system (not shown). These filament bundles typically each contain from about 15 to 150 individual filaments.

The filaments 5 are drawn downwardly at high velocity by the jet system, i.e., at a preferred velocity of at least about 150 feet per second, and more preferably at least about 250 feet per second. The maximum velocity is preferably up to about 450 feet per second, and more preferably up to about 350 feet per second.

"Heavy denier" for purposes of this invention is defined as a denier of at least 4, and preferably a denier of at least 6. However, from a practical standpoint, filaments up to about 15 denier can be economically run with this system.

The filaments 5 are drawn through the high velocity jet system and exit the system through an opening in discharge means 2. Discharge means 2 comprises, for example, any means having a slitted opening which is capable of downwardly transporting the filaments to the web-forming means, such as a tube, pipe or nozzle. However, it is preferred that the discharge means 2 comprises a means capable of causing dispersion of filaments 5 in a plane parallel to opposed Coanda surfaces 3. Preferably, as shown in FIG. 2, a fan-shaped, diverging nozzle means 2*a*, having its largest dimension 2*b* located substantially parallel to the Coanda surfaces, can be employed for this purpose. Such a configuration promotes dispersion of filaments 5 in a plane parallel to the Coanda surfaces 3, while the hereinafter described Coanda nozzles, which preferably comprise auxiliary fluid supply means 4 and Coanda surfaces 3, promote dispersion of the filaments in a plane perpendicular to Coanda surfaces 3. Thus, in the above embodiment, a two-dimensional dispersion of filaments 5 is therefore accomplished. This, in turn, promotes an even more uniform deposition pattern of filaments on the web-forming surface 6, which results in the formation of an even better product with respect to uniformity and strength.

Effective filament dispersion in a plane perpendicular to Coanda surfaces 3, as depicted in FIG. 1, is essentially accomplished in a dispersion region denoted "8", located below discharge means 2 and between respective outer portions 3*a* of Coanda surfaces 3. This latter filament disperson is accomplished by creating a Coanda effect via the above described Coanda nozzles. Specifically, dispersion in a perpendicular plane is accomplished by employing a Coanda effect in which a pulsating fluid, preferably air, is supplied, preferably at low pressure, under conditions whereby the flow of said pulsating fluid follows the curved contour of Coanda surfaces 3. By imparting a Coanda effect to the filaments 5 using a pulsating fluid as they pass within region 8, filament oscillation in a perpendicular plane will take place.

An auxiliary fluid supply means is employed for supplying a pulsating fluid under the above described conditions to provide the requisite Coanda effect under nonsteady-state conditions. The auxiliary fluid supply means, which, together with the Coanda surfaces, constitutes a Coanda nozzle, can be a separate or integral part of the Coanda surface. In its separate form, as shown in FIG. 1, it comprises auxiliary fluid supply means 4, which preferably includes a fluid outlet means 4*a* joined at one end to a fluid-supply line which receives the supply fluid from a remote source (not shown). Fluid outlet means 4*a* preferably includes a narrow slit at its outer end, preferably from about 0.003 inch to 0.03 inch in size.

The Coanda nozzle operates at flow rates and pressures which produce the requisite Coanda effect. However, from an economic standpoint, the lower ranges of energy consumption are preferred. Thus, for example, the pressure of the fluid emanating from auxiliary means 4 is preferably maintained at a substantially low level. Typically, the pressure at the exit of auxiliary means 4 is maintained at from about 5 psig, and more preferably at about 15 psig, up to about 30 psig, and more preferably up to about 20 psig.

The supply fluid is transported for attachment to the outer surfaces 3*a* of Coanda surfaces 3 in a pulsating manner. Thus, the pulsating action of the fluid as it exits the auxiliary supply means 4 causes nonsteady-state oscillation of filaments 5 in an amplitude perpendicular to surfaces 3*a*, thereby facilitating subsequent filament dispersion. Preferably, a fluid-pulsating rate of from about 5 pulses per second, and more preferably up to about 20 pulses per second, up to about 100 pulses per second, and preferably up to about 50 pulses per second, is employed to promote nonsteady-state oscillation. The pulsating fluid can be provided by any conventional fluidic or mechanical pulsating apparatus.

Preferably, the fluid is also supplied intermittently from means 4 so that the filaments oscillate in an alternating mode with respect to each of the Coanda surfaces 3. In FIG. 1, for example, filaments 5 are depicted traversing a gradually increasing amplitude as they are discharged from the jet system and move toward web-forming surface 6. The extent of the path of oscillation of filaments 5 in a perpendicular plane to Coanda surfaces 3 is shown by filaments 5*a* (in phantom). As opposed to the prior art symmetrical filament pattern, the filament pattern provided herein by the system for this invention is nonsymmetrical, which further promotes dispersion of the filaments.

Auxiliary fluid supply means 4 is preferably connected to Coanda surfaces 3. Furthermore, fluid outlet means 4*a* is preferably located at the converging portions of Coanda surfaces 3, thereby promoting the flow of fluid downwardly along the curved contour thereof to create the requisite Coanda effect.

The Coanda surface portion of the Coanda nozzle can comprise any surface configuration capable of having a Coanda effect created thereon. Typically, Coanda surfaces can be in the form of a semicircle, ellipse, air-foil, or the like.

The method herein comprises discharging a plurality of filaments 5 in a downward direction at high velocity and introducing same into a dispersion region formed between respective opposed Coanda nozzles. Then, the filaments are moved in a downward direction past the point at which the pressure drop is generated by the Coanda nozzles so that the filaments are alternatively oscillated in a plane perpendicular to said Coanda nozzles by the application of a Coanda effect, which is imparted to the filaments in a pulsating, intermittent manner. A non-steady-state condition is thus created, causing a nonsymmetrical filament pattern to be formed in the dispersion region, which, in turn, promotes the effective dispersion of the filaments. This generates a gradually increasing amplitude as the filaments 5 and 5*a*, respectively, move in a downward direction toward fiber-forming surface 6. Finally, a nonwoven web 10 is produced by depositing filaments 5 on a moving web-forming surface 6 located below dispersion region 8.

The nonwoven web 10 formed has excellent uniformity and strength properties. To facilitate the formation of nonwoven web 10, a vacuum box 7, or other like conventional apparatus capable of assisting in the formation of nonwoven web 10, is employed at the point at which filaments 5 are deposited on web-forming means 6.

We claim:

1. A method for producing a plurality of filaments in a dispersed condition, which comprises:

(a) discharging said filaments in a downward direction at high velocity;

(b) introducing said discharged filaments into a dispersion region formed between opposed Coanda nozzles, said Coanda nozzles comprising an auxiliary fluid supply means and opposed Coanda surfaces;

(c) applying a Coanda effect to said discharged filaments within the dispersion region by transporting a pulsating fluid intermittently in an alternating mode, from said auxiliary supply means and attaching said pulsating fluid to the outer surfaces of said opposed Coanda surfaces under conditions whereby the fluid flow follows the curved contour of said Coanda surfaces to create said Coanda effect, thereby causing nonsteady-state conditions with respect to the opposed Coanda surfaces to be created, and a nonsymmetrical filament flow pattern to be formed within the dispersion region, so that the filaments move in a downward direction past said opposed Coanda nozzles and are alternatively oscillated in a plane perpendicular to said Coanda surfaces by the action of the Coanda effect.

2. The method of claim 1, wherein said pulsating fluid is supplied at low pressure.

3. The method of claim 2, wherein the pressure at the exit of said auxiliary fluid supply means is maintained at from about 5 psig up to about 30 psig.

4. The method of claim 1, wherein the velocity of said downwardly discharged filaments is at least about 150 feet per second, up to a maximum velocity of about 450 feet per second.

5. The method of claim 1, wherein the pulsating action of the fluid as it exits the auxiliary supply means is maintained at a fluid-pulsating rate of from about 5 pulses per second, up to about 100 pulses per second.

6. The method of claim 1, wherein said filaments are comprised of heavy denier filaments.

7. A system for producing a plurality of filaments in a dispersed condition, which comprises (a) opposed Coanda nozzles adapted to create a non-steady-state, nonsymmetrical filament flow pattern by the application of a Coanda effect to said filaments, the Coanda nozzles comprising opposed Coanda surfaces and an auxiliary means for supplying a pulsating fluid in an intermittent, alternating mode, respectively; and (b) means for discharging said filaments, in a fluid medium, at high velocity, into a dispersion region formed between said opposed Coanda nozzles, wherein, as the filaments move in a downward direction past the opposed Coanda nozzles, the filaments are oscillated in a plane perpendicular to the Coanda surfaces by the action of the Coanda effect.

8. The system of claim 7, wherein said auxiliary fluid supply means includes fluid outlet means which engages said Coanda surfaces.

9. The system of claim 8, wherein said fluid outlet means is attached to said Coanda surfaces.

10. The system of claim 8, wherein said fluid outlet means engages said Coanda surfaces at the converging portions of said Coanda surfaces, thereby promoting the fluid downwardly along the curve of contour thereof to create said Coanda effect.

11. The apparatus of claim 7, wherein said discharge means includes means for providing for a two-dimensional disperion of said filaments.

12. The system of claim 11, wherein said two-dimensional dispersion means comprises a fan-shaped, diverging nozzle means.

13. The system of claim 7, wherein said filaments are comprised of heavy denier filaments.

* * * * *